US009900939B2

(12) United States Patent
Eberson et al.

(10) Patent No.: US 9,900,939 B2
(45) Date of Patent: Feb. 20, 2018

(54) LED DRIVER, LIGHTING SYSTEM AND DRIVING METHOD WITH PROLONGED LIFETIME OF LUMINOUS OUTPUT

(71) Applicant: PHILIPS LIGHTING HOLDING B.V., Eindhoven (NL)

(72) Inventors: Etienne Nicolaas Kathalijntje Paulus Marie Eberson, Echt (NL); Christian Kalkschmidt, Aachen (DE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/913,137

(22) PCT Filed: Aug. 18, 2014

(86) PCT No.: PCT/IB2014/063948
§ 371 (c)(1),
(2) Date: Feb. 19, 2016

(87) PCT Pub. No.: WO2015/025257
PCT Pub. Date: Feb. 26, 2015

(65) Prior Publication Data

US 2016/0212807 A1 Jul. 21, 2016

(30) Foreign Application Priority Data

Aug. 19, 2013 (EP) ..... 13180937
Jan. 24, 2014 (EP) ..... 14152469

(51) Int. Cl.
*H05B 33/08* (2006.01)

(52) U.S. Cl.
CPC ..... *H05B 33/0815* (2013.01); *H05B 33/0854* (2013.01); *H05B 33/0893* (2013.01); *H05B 33/0896* (2013.01)

(58) Field of Classification Search
CPC ..... H05B 33/0815; H05B 33/0854; H05B 33/0893; H05B 33/0896
USPC ..... 315/297
See application file for complete search history.

(56) References Cited

U.S. PATENT DOCUMENTS

| | | | | |
|---|---|---|---|---|
| 6,456,016 | B1 | 9/2002 | Sundahl et al. | |
| 8,111,388 | B2 | 2/2012 | Glandt et al. | |
| 2001/0033503 | A1 | 10/2001 | Hamp et al. | |
| 2006/0028155 | A1 | 2/2006 | Young | |
| 2011/0089855 | A1* | 4/2011 | Roberts | H05B 33/0893 315/291 |
| 2012/0032612 | A1* | 2/2012 | Antony | H05B 33/089 315/297 |

(Continued)

FOREIGN PATENT DOCUMENTS

| | | | |
|---|---|---|---|
| EP | 1973385 | A1 | 9/2008 |
| JP | 2005285529 | A | 10/2005 |

(Continued)

OTHER PUBLICATIONS

"OSRAM Quicktronic Economic FM ECG for FL 7 MM", www.osram.com, Nov. 14, 2013, pp. 1-4.

*Primary Examiner* — Dylan White

(57) ABSTRACT

An LED driver implements a first constant-current drive scheme for a first range of sensed voltages up to a threshold voltage. After this, a second drive scheme is implemented with a current lower than the constant current of the first drive scheme.

13 Claims, 9 Drawing Sheets

(56) References Cited

U.S. PATENT DOCUMENTS

| | | | | |
|---|---|---|---|---|
| 2012/0187847 | A1* | 7/2012 | Hamamoto | H05B 33/0815 315/125 |
| 2012/0274233 | A1* | 11/2012 | Chen | H05B 33/0815 315/294 |
| 2013/0234594 | A1 | 9/2013 | Huang | |
| 2013/0257298 | A1* | 10/2013 | Cheon | H05B 37/02 315/185 R |
| 2013/0278145 | A1* | 10/2013 | Lin | H05B 33/0851 315/122 |
| 2014/0300274 | A1* | 10/2014 | Acatrinei | H05B 33/0815 315/85 |
| 2015/0028774 | A1* | 1/2015 | Konishi | H05B 33/089 315/302 |

FOREIGN PATENT DOCUMENTS

| | | | |
|---|---|---|---|
| JP | 2010093874 | A | 4/2010 |
| WO | 2011056242 | A1 | 5/2011 |

* cited by examiner

LED DRIVER, LIGHTING SYSTEM AND DRIVING METHOD WITH PROLONGED LIFETIME OF LUMINOUS OUTPUT

CROSS-REFERENCE TO PRIOR APPLICATIONS

This application is the U.S. National Phase application under 35 U.S.C. §371 of International Application No. PCT/IB2014/063948, filed on Aug. 18, 2014, which claims the benefit of European Patent Application No. 13180937.8, filed on Aug. 19, 2013 and European Patent Application No. 14152469.4, filed on Jan. 24, 2014. These applications are hereby incorporated by reference herein.

FIELD OF THE INVENTION

This invention relates to LED lighting, LED drivers and LED driving methods.

BACKGROUND OF THE INVENTION

In this description and claims, the term "LED" will be used to denote both organic and inorganic LED's, and the invention can be applied to both categories. LEDs are current driven lighting units. They are driven using an LED driver which delivers a desired current to the LED.

The required current to be supplied varies for different lighting units, and for different configurations of lighting unit. The latest LED drivers are designed to have sufficient flexibility that they can be used for a wide range of different lighting units, and for a range of numbers of lighting units.

To enable this flexibility, it is known for the driver to operate within a so-called "operating window". An operating window defines a relationship between the output voltage and output current than can be delivered by the driver. Providing the requirements of a particular lighting load fall within this operating window, the driver is able to be configured for use with that particular lighting load, giving the desired driver flexibility.

When an LED is driven to the desired current, the resulting voltage can vary in dependence on the characteristics of the LED itself. The operating window means that for each given current setting, there is a maximum voltage which can be supplied by the driver, before the limit of the permitted power supply is reached.

One of the degradation behaviours of an LED, in particular OLEDs, is the increase of the LED forward voltage over lifetime when driven at a constant current. As the current remains the same over the complete lifetime cycle, the increase of voltage creates an increase of power. The increase of power creates a higher temperature which in turn will increase the degradation of the LED even faster.

To prevent that the temperature of the LED becomes too high, the end-of-life (EOL) behaviour of the driver arranged is to switch off the output when the defined EOL LED voltage is reached.

A typical operating window of a window driver is shown in FIG. 1, which shows a region of permitted current and voltage values. For this arbitrary example, the LED driver can deliver any load current between 100 mA and 500 mA. There is an allowed voltage of 5 to 28 Volts and a maximum power of 10 Watt. The maximum power setting defines the curved part of the window boundary at the higher current and higher voltage regions, and the curve is of course defined by V(Volts)*I(Amps)<10.

FIG. 1 additionally shows the behaviour of a typical EOL solution when a 350 mA, 20 Volt OLED is operated over a long time period. The operating point moves over lifetime from point A, through B, C, D, E and F to point G. When the operating point reaches point G, the driver will switch off the OLED.

As mentioned above, the disadvantages of the current EOL implementation in particular for OLEDs are the increase of power, thus creating a higher temperature of the LED and with this increase of temperature, an accelerating degradation of the LED. This will faster increase the LED voltage, thus creating an even faster power increase. There is therefore an accelerated ageing process.

In the above example, the power over lifetime changes from 5.6 Watt at point A to 9.8 Watt at point G, which is nearly double the initial power.

FIG. 2 shows a plot over time of the electrical parameters (current, voltage and power output) of an LED when controlled using a constant current approach as shown in FIG. 1. The current remains constant to the end of life. The voltage and therefore power increase is not linear, but increases more rapidly over time as a result of the accelerated ageing caused by the increased heating as the power increases.

The constant current control is therefore not an optimum way to drive the LED if the lifetime is to be maximised.

SUMMARY OF THE INVENTION

The invention is defined by the claims.

According to the invention, there is provided an LED driver, comprising:

a current driver, a voltage sensor for sensing an LED voltage; and a controller for controlling the current driver, wherein the controller is adapted to:

operate a first drive scheme for a first range of sensed voltages up to a threshold voltage, during which first drive scheme a first constant current is applied; and operate a second drive scheme when the first constant current results in a higher sensed voltage than the threshold voltage, during which second drive scheme a current lower than the first constant current is applied.

This driver only applies a constant current drive scheme until a threshold voltage is reached. This corresponds to a threshold power. By changing to a drive scheme which then allows the current to be reduced, it is prevented that the power continues to increase. This reduces heating and thereby slows the further degradation of the LED. The lifetime of the LED can be extended in this way.

During the second drive scheme the voltage can be regulated to be constant at the threshold voltage. In this way, as the current decreases in response to continued ageing, the power will reduce over time.

In another approach, during the second drive scheme the current can be stepped between discrete values, with the stepping taking place at the threshold voltage. This enables a hysteresis to be implemented, which can give a more stable control. The voltage is limited to the threshold voltage but it will step down and ramp up over time as the LED ages.

In yet another approach, during the second drive scheme the power can be regulated to be constant. This requires a relationship between current and voltage to be established.

Other functions can be implemented, providing there is a reduction in current over time, in order to halt or slow down the increase in voltage which would result from constant current control, and thereby slow down or halt the power increase which can give rise to accelerated ageing.

The controller can comprise a microprocessor or an analogue circuit or a combination of these. Thus, the control can be implemented in hardware or software or a combination of these. The driver typically comprises an operating window driver having a current-voltage operating window.

The invention also provides a lighting system comprising:

an LED driver arrangement of the invention; and an LED unit powered by the LED driver.

The LED unit can comprise one or more OLEDs.

The invention also provides a method of driving an LED using a current driver, comprising:

sensing an LED voltage;

operating a first drive scheme for a first range of sensed voltages up to a threshold voltage, during which first drive scheme a first constant current is applied; and operating a second drive scheme when the first constant current results in a higher sensed voltage than the threshold voltage, during which second drive scheme a current lower than the first constant current is applied.

The method can comprise detecting if the voltage is below the threshold (or below the threshold by more than a fixed amount) when the current setting is below the first constant current, and if so increasing current setting. The second drive scheme may for example have been initiated because the LED is in cold-start state, whereas when warmed up the current could be increased to the desired level. Thus, the control enables the current to be increased to the desired current setting if the reduced-current control is no longer needed. In this way, the control can revert to the first drive scheme (which is preferred because it gives full brightness output) if possible.

BRIEF DESCRIPTION OF THE DRAWINGS

Examples of the invention will now be described in detail with reference to the accompanying drawings, in which.

The invention provides an LED driver in which a first constant-current drive scheme is implemented for a first range of sensed voltages up to a threshold voltage. After this, a second drive scheme is implemented with a current lower than the constant current of the first drive scheme.

The driver is thus controlled to limit the operating voltage over lifetime by reducing the output current, thus limiting the power increase and temperature increase over time. This enables the useable lifetime of the LED to be extended.

Figure 1:
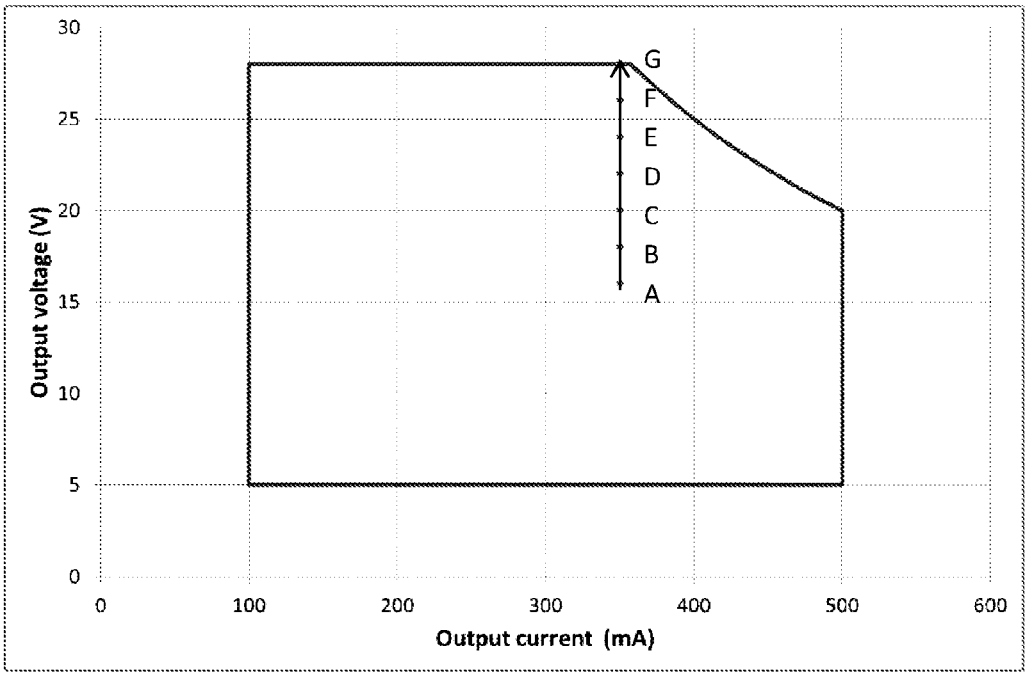
FIG. 1 shows an operating window of an LED driver and shows how the setting evolves over time as an LED ages, for a known control approach.
Figure 2:
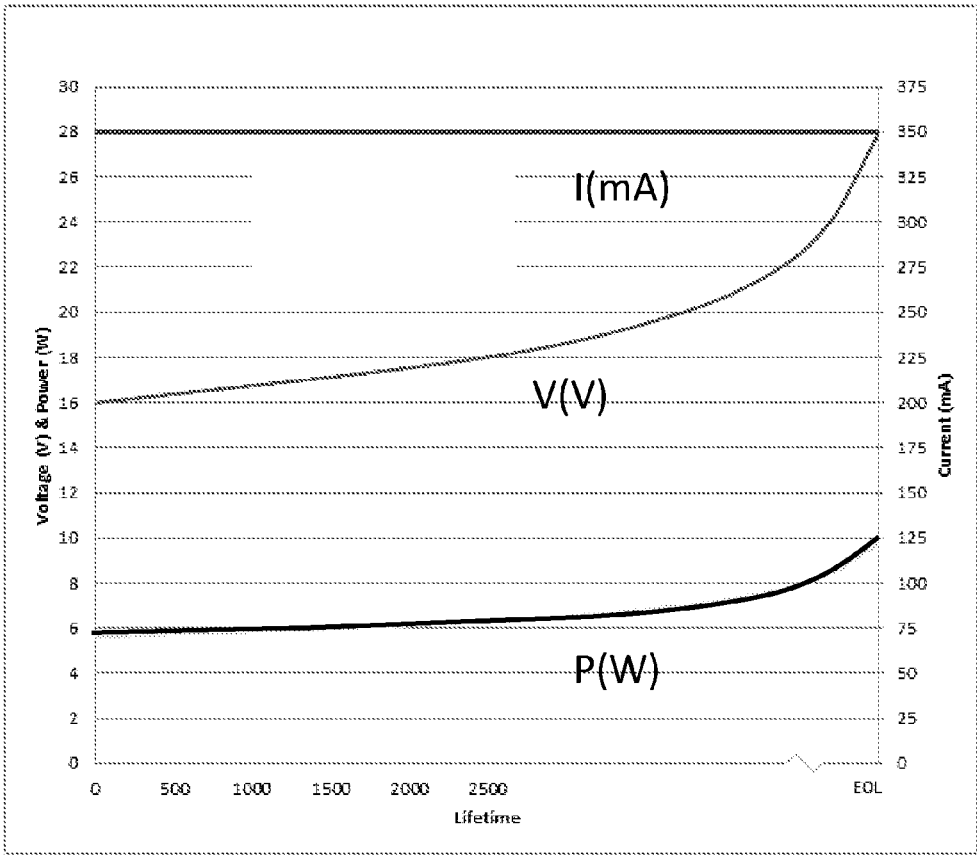
FIG. 2 shows how the current, voltage and power evolve over time for the control of FIG. 1.
Figure 3:
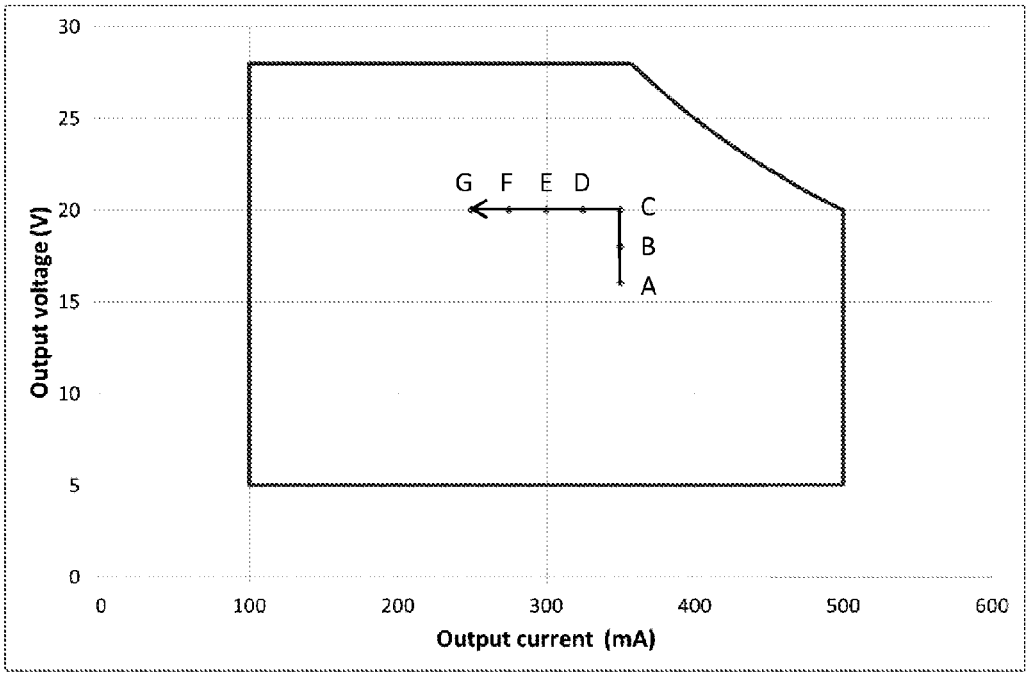
FIG. 3 shows a first example of control approach with non-constant current.

FIG. 3 shows a first example of how the operating point of a 16 Volt LED (such as an OLED) is controlled as the LED ages. The LED is controlled with a fully regulated output voltage of 350 mA while the output voltage remains below 20 Volts, which is thus the EOL voltage of the LED.

At the start of the lifetime of the LED, the operating point is located at A (16 Volt, 350 mA). When the LED voltage increases due to degradation, it will reach point B and later on point C.

When point C is reached, the control changes from the previous fixed current and voltage regulation scheme. This was a first drive scheme for a first range of sensed voltages, up to the EOL voltage. The current is instead gradually decreased to maintain the LED voltage at the set EOL voltage, in this can 20 Volt (Point D). This is a second drive scheme. Thus, fixed voltage control takes over which gives rise to a reduction in current as the device further ages, from operating point C to G.

Figure 4:
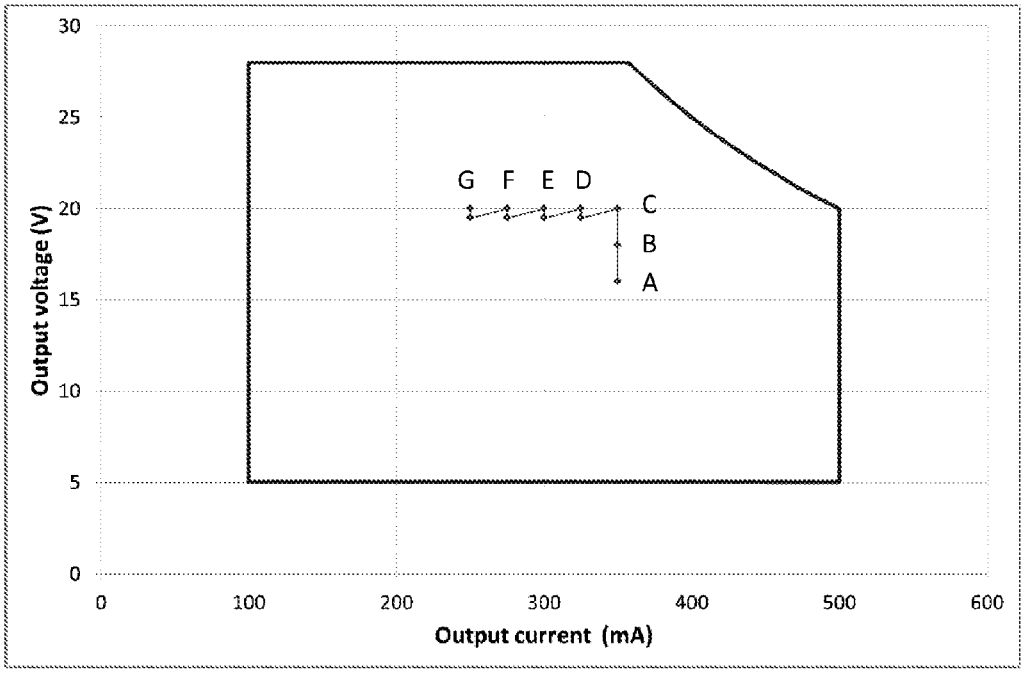
FIG. 4 shows a second example of control approach with non-constant current.

Other implementations are also possible. FIG. 4 shows a hysteresis control to prevent instable behaviour of the LED which could occur due to the continuous control of the output voltage in the example of FIG. 3. In this example, a hysteresis window of 0.5 Volt is used. Thus, each time the 20 Volt EOL voltage is reached, the voltage is reduced to 19.5 Volts and the resulting current is maintained at a constant level until the EOL voltage is reached again.

The control can be implemented in software as an algorithm which controls the driver settings.

The algorithm should be able to implement an increase in current setting in some situations. For example, the EOL algorithm can be triggered when an aged, cold LED is switched on and the initial LED voltage rises above the EOL trigger level (the 20 Volts in this example). When the LED heats up to the steady-state point, the LED voltage reduces again back to the nominal voltage of the aged LED.

For example assuming a 16 Volt, 350 mA LED has been used for a quite a long time and the LED voltage increase due to degradation has caused the LED voltage to reach 19.5 Volt at steady-state. At switch on of the cold LED, the LED voltage temporary reaches 21 Volts and when the LED heats up, it will reduce back to the previously mentioned 19.5 Volts. In this case, the EOL algorithm should be able to both increase and decrease the current depending on the prevailing conditions. When the voltage increases above the EOL trigger level, it should reduce the current as shown in FIG. 4. However, when the LED current is reduced and the LED voltage subsequently decreases (for example as explained above), the algorithm should be able to increase the LED current, but not surpassing its maximum original setting.

Figure 5:
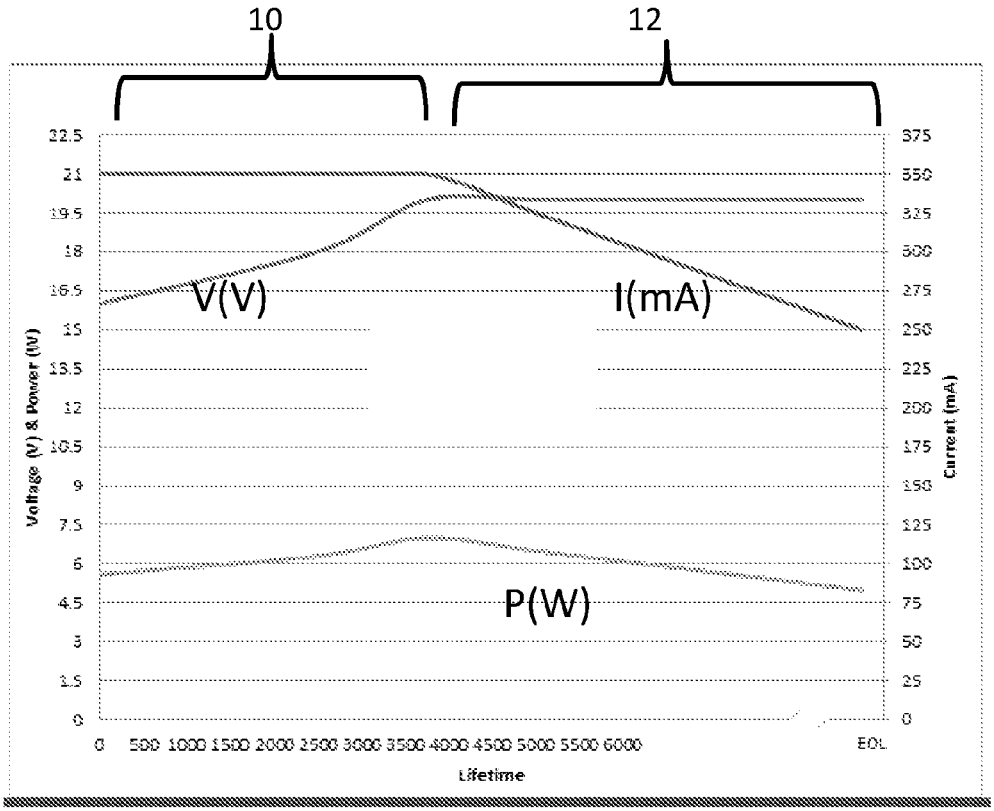
FIG. 5 shows how the current, voltage and power evolve over time for the control of FIG. 3.

FIG. 5 shows the behaviour of the electrical parameters (current, voltage and power) of the LED over lifetime is depicted. The x-axis shows time, up to the end of life EOL. The EOL is typically defined based upon the light output level. Depending on specification the EOL can be the so-called L70 point (light output reduced to 70% of initial value) or the so-called L50 point (light output reduced to 50% of initial value).

The initial time period 10 shows the first control scheme which is constant current control. At the end of the time period 10, the set EOL voltage is reached, and the control switches to the second control scheme which in this example is constant voltage control during time period 12 (i.e. the version of FIG. 3). During this time, the current decreases over time. As the power of the LED is not increasing substantially (indeed in this example the power reduces during time period 12), the temperature of the LED will not increase, thus substantially reducing the degradation of the LED. By reducing the degradation, the lifetime of the LED is increased substantially.

Figure 6:
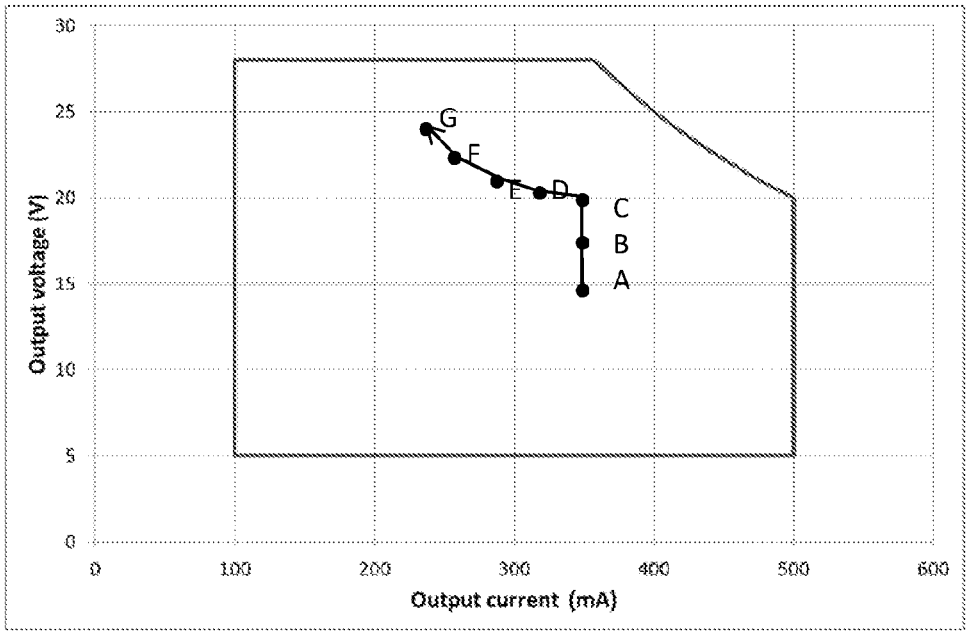
FIG. 6 shows a third example of control approach with non-constant current.

The approach above is based on switching from constant current control when a set maximum voltage is reached. An alternative is to set a maximum power. The resulting control settings are shown in FIG. 6. The settings follow a constant power curve between points C and G.

Figure 7:
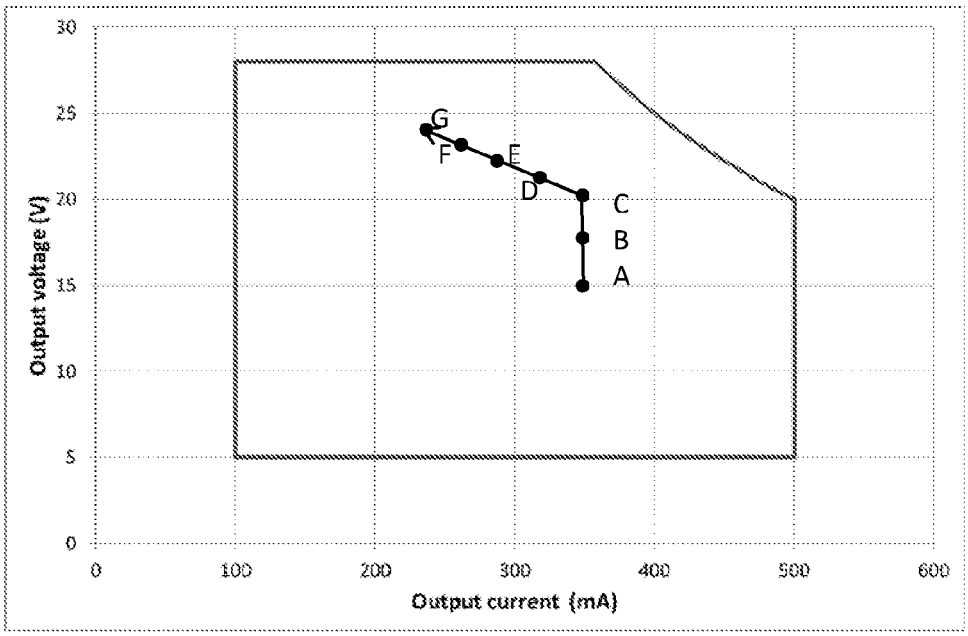
FIG. 7 shows a fourth example of control approach with non-constant current.

Other functions can be used. For example, FIG. 7 shows the settings following a linear relationship between current and voltage after the switching point (point C) has been reached.

As mentioned above the system can be implemented in software as part of an LED driver but it can also be implemented in hardware. By implementing an algorithm in software, a more flexible design can be developed.

Figure 8:
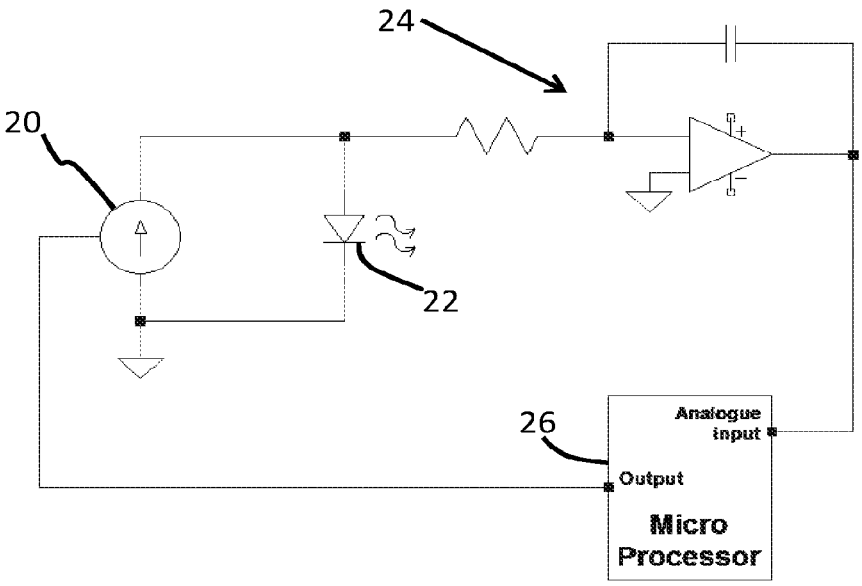
FIG. 8 shows a first way to implement the control approach in simplified schematic form.

FIG. 8 shows in schematic form a software solution.

The LED driver is represented as a controllable current source 20 which drives current through the LED 22. Typically, the controllable current source comprises a DC-DC converter with control of the output current for example using pulse width modulation. The controllable current source can be implemented using a buck converter, a boost converter or a buck-boost converter for example. Generally, any switch mode power converter can be used. The LED voltage is sensed by a comparator circuit 24 and the sensed voltage is provided as analogue input to a microprocessor 26. The microprocessor implements the control algorithm and provides the desired control of the driver 20.

Figure 9:
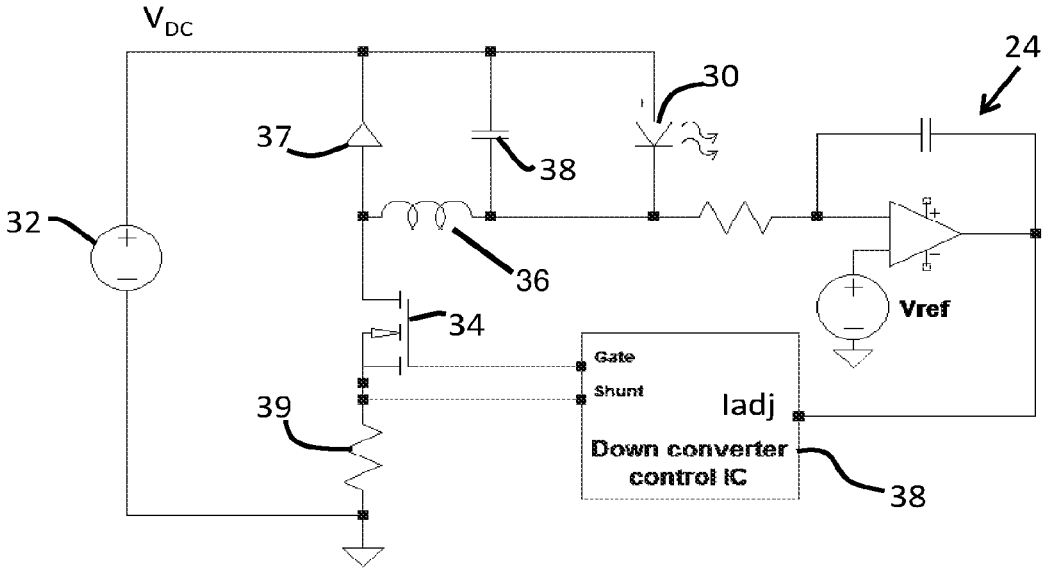
FIG. 9 shows a second way to implement the control approach based on a buck converter architecture.

FIG. 9 shows a hardware implementation, and additionally shows the components of a buck converter.

LEDs are typically driven using a DC-DC converter. The converter accepts a DC input voltage (which may be unregulated) and provides a regulated DC output voltage. The unregulated DC input voltage is typically derived from a mains AC power source which is rectified and filtered by a bridge rectifier/filter circuit arrangement.

FIG. 9 shows a circuit diagram of a conventional step-down DC-DC buck converter configured to provide a regulated DC output voltage to the LED load 30, based on a higher unregulated DC input voltage 32.

DC-DC converters like the buck converter of FIG. 9 employ a transistor or equivalent device 34 that is configured to operate as a saturated switch which selectively allows energy to be stored in an energy storage device 36. The energy storage device 36 is shown as an inductor in FIG. 9.

The transistor switch 34 is operated to periodically apply the unregulated DC input voltage 32 across the inductor 36 for relatively short time intervals (in FIG. 9 a single inductor is depicted to schematically represent one or more actual inductors arranged in any of a variety of serial/parallel configurations to provide a desired inductance).

During the intervals in which the transistor switch is "on" or closed and thereby passing the input voltage to the inductor, current flows through the inductor based on the applied voltage and the inductor stores energy in its magnetic field. When the switch is turned "off" or opened so that the DC input voltage is removed from the inductor, the energy stored in the inductor is transferred to a filter capacitor 38 which functions to provide a relatively smooth DC output voltage to the LED load 30.

When the transistor switch 34 is on, a voltage is applied across the inductor. This applied voltage causes a linearly increasing current to flow through the inductor (and to the load and the capacitor) based on the relationship $V_L = L dI_L/dt$.

When the transistor switch 36 is turned off, the current $I_L$ through the inductor continues to flow in the same direction, with a diode 37 now conducting to complete the circuit. As long as current is flowing through the diode 37, the voltage $V_L$ across the inductor is fixed, causing the inductor current $I_L$ to decrease linearly as energy is provided from the inductor's magnetic field to the capacitor and the load.

The transistor is controlled by a down converter control IC, which essentially functions as a PWM controller 38. This operates as a dimming controller which sets the LED current level in response to a desired dimming setting. The controller has an input "Iadj" which receives a signal from a comparator circuit 24, and this input is interpreted to determine how to control the current setting, in order to implement the control approaches explained above. Resistor 39 is a buck inductor current sensing resistor which is used for control of the PWM controller 38.

The hardware implementation provides modification to the PWM controller 38 so that the conventional dimming control is enhanced by taking account of the voltage measurement as provided to the Iadj pin from the comparator circuit 24.

Note that circuit of FIG. 8 uses measurement of the LED voltage with respect to ground whereas the circuit of FIG. 9 uses measurement of the LED voltage with respect to the high voltage $V_{DC}$ of the input supply. In FIG. 8, the measured voltage is $V_{OLED}$ whereas in FIG. 9 the measured voltage is $V_{DC}-V_{OLED}$.

Figure 10:
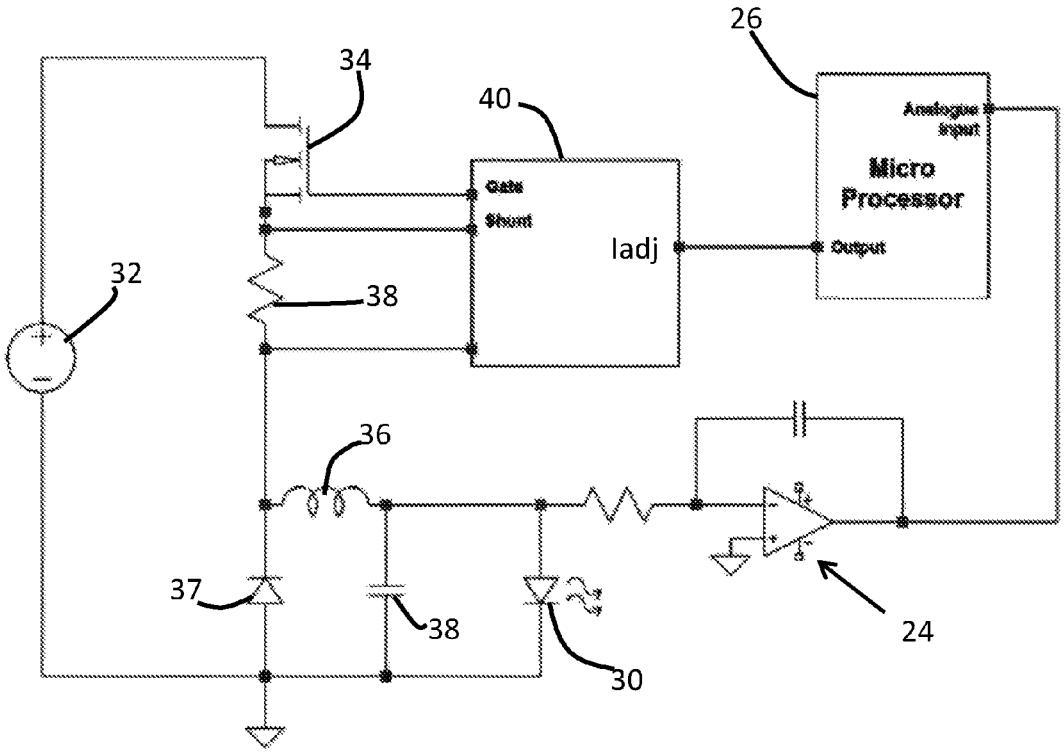
FIG. 10 shows the control approach of FIG. 8 in more detail also based on a buck converter architecture.

FIG. 10 shows the microprocessor version of FIG. 8 applied to a buck converter similar to that shown in FIG. 9. The buck converter components are given the same references as in FIG. 9. Whereas FIG. 9 requires a modified controller 38, the circuit of FIG. 10 can use a standard controller 40. The microprocessor implements the control algorithm and provides an output to the Iadj pin of the standard controller 40 to provide the desired control of the output current.

Figure 11:
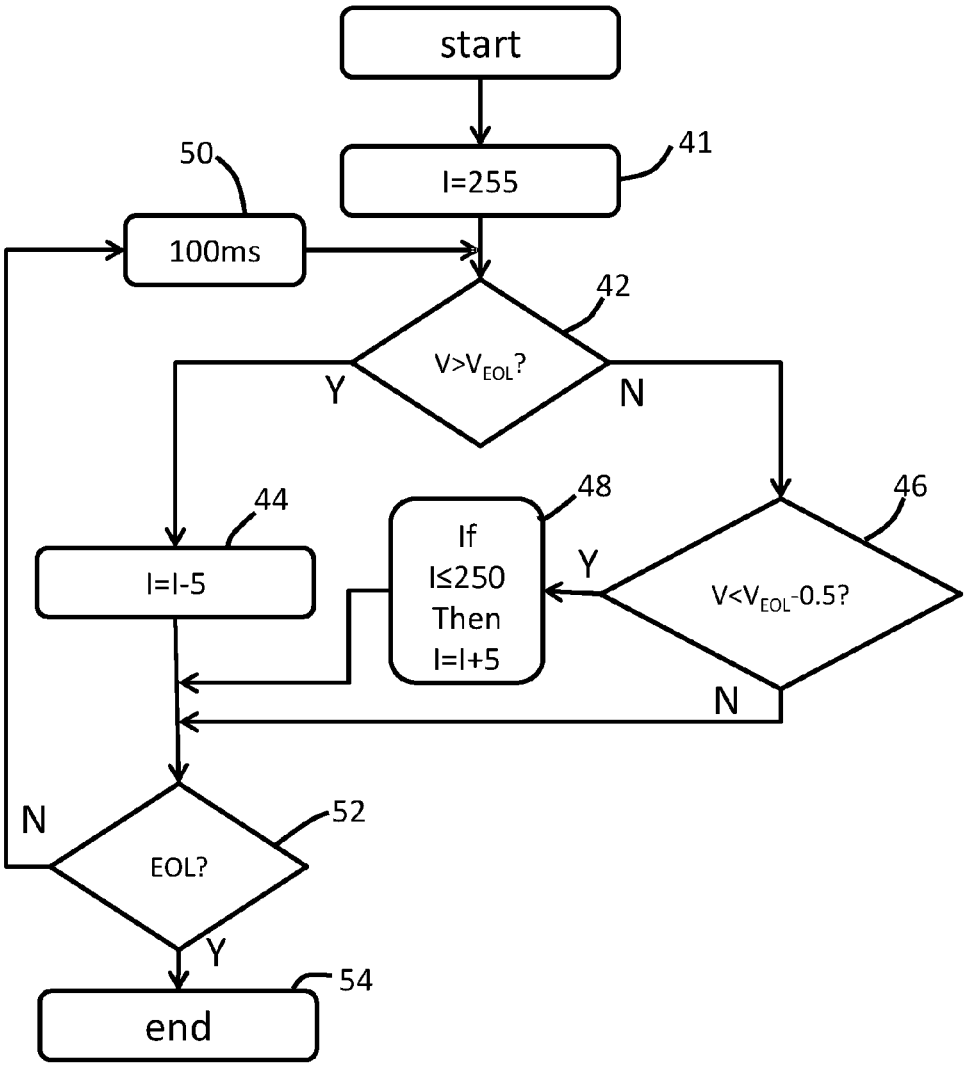
FIG. 11 is a flow chart to explain the control approach of FIG. 4.

FIG. 11 is a flow chart showing one example of control method, for implementing the control shown in FIG. 4.

In step 41, the desired current setting (e.g. 350 mA) is set as value 255. In step 42 the LED voltage is monitored. If it exceeds the EOL voltage at which the control shifts away from constant current control, then the target current is reduced by 5 points in step 44 (i.e. reduced by 5/255 of the target current). If the LED voltage does not exceed the EOL voltage, it is determined if the voltage is below the level $V_{EOL}-0.5$ in step 46. This implements the hysteresis control. If is not below this level then no change is made to the target current.

If the voltage is below $V_{EOL}-0.5$, this can indicate that the current can be ramped higher, for example because the LED has warmed up. In step 48 the current setting is increased by 5 points if it is not already at the maximum 255 setting.

The new current setting is applied each 100 ms (step 50) while the LED has not yet reached its end of life (as determined in step 52). At the end of life, the algorithm ends in step 54.

This is only one example of control algorithm, and others will be apparent to those skilled in the art for the other possible control approached described above.

The system described above provides an intelligent control system which reduces the output (current) when the LED voltage reaches its EOL defined voltage or power output. This enables the usable lifetime to be extended, and also the aging effect due to the power increase is reduced.

The voltage level at which the control scheme changes will determine the degree to which the lifetime can be extended. The disadvantage of switching to current control is that the brightness is affected. Thus, there is a trade off between the lifetime extension and the time during which the brightness is reduced. By way of example the voltage used as a threshold can be in the range of 50% to 90% of the maximum voltage which the driver can deliver at the constant current setting (i.e. the upper boundary of the operating window at the set current). The end of life will be reached when the current reaches a level corresponding to the defined brightness limit (e.g. 70% or 50%). However, this is reached after a longer time than the maximum voltage is reached in the constant current control method.

The invention is of interest for organic and inorganic LED drivers.

The invention makes use of a controller. The controller can be implemented in numerous ways, with software and/or hardware, to perform the various functions discussed above. For a software implementation, a microprocessor as shown can be used. This is only one example of a controller that may be programmed using software (e.g., microcode) to perform the required functions. A controller may however be implemented with or without employing a processor, and also may be implemented as a combination of dedicated hardware to perform some functions and a processor (e.g., one or more programmed microprocessors and associated circuitry) to perform other functions.

Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media such as volatile and non-volatile computer memory such as RAM, PROM, EPROM, and EEPROM. The storage media may be encoded with one or more programs that, when executed on one or more processors and/or controllers, perform at the required functions. Various storage media may be fixed within a processor or controller or may be transportable, such that the one or more programs stored thereon can be loaded into a processor or controller.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. An LED driver, comprising:

a current driver, a voltage sensor for sensing an LED voltage; and a controller for controlling the current driver, wherein the controller is adapted to:

operate a first drive scheme for a first range of sensed voltages up to a threshold voltage, wherein a first constant current is applied during the first drive scheme; and operate a second drive scheme when the first constant current results in a higher sensed voltage than the threshold voltage, wherein a current lower than the first constant current is applied during the second drive scheme, wherein during the second drive scheme the voltage is regulated to be constant at the threshold voltage.

2. An LED driver as claimed in claim 1, wherein during the second drive scheme the current is stepped between discrete values, with the stepping taking place at the threshold voltage.

3. An LED driver as claimed in claim 1, wherein during the second drive scheme the power is regulated to be constant.

4. An LED driver as claimed in claim 1, wherein the controller comprises a microprocessor.

5. An LED driver as claimed in claim 1, wherein the controller comprises an analogue circuit.

6. An LED driver as claimed in claim 1, wherein the driver comprises an operating window driver having a current-voltage operating window.

7. A lighting system comprising:

an LED driver arrangement as claimed in claim 1; and an LED unit powered by the LED driver.

8. A lighting system as claimed in claim 7, wherein the LED unit comprises one or more OLEDs.

9. A method of driving an LED using a current driver, comprising:

sensing an LED voltage;

operating a first drive scheme for a first range of sensed voltages up to a threshold voltage, wherein a first constant current is applied during the first drive scheme; and operating a second drive scheme when the first constant current results in a higher sensed voltage than the threshold voltage, wherein a current lower than the first constant current is applied during the second drive scheme, wherein during the second drive scheme the voltage is regulated to be constant at the threshold voltage.

10. A method as claimed in claim 9, wherein during the second drive scheme the current is stepped between discrete values, with the stepping taking place at the threshold voltage.

11. A method as claimed in claim 9, wherein during the second drive scheme the power is regulated to be constant.

12. A method as claimed in claim 9, comprising detecting if the voltage is below the threshold or below the threshold by more than a fixed amount when the current setting is below the first constant current, and if so increasing current setting.

13. A method as claimed in claim 9, wherein the driver comprises an operating window driver having a current-voltage operating window.

* * * * *